US007058341B2

(12) United States Patent
Kellie

(10) Patent No.: US 7,058,341 B2
(45) Date of Patent: Jun. 6, 2006

(54) ELECTROSTATIC TRANSFER TYPE LIQUID ELECTROPHOTOGRAPHIC PRINTER USING A CONTINUOUS PHOTORECEPTOR WEB AS A PHOTORECEPTOR MEDIUM

(75) Inventor: Truman F. Kellie, Lakeland, MN (US)

(73) Assignee: Samsung Electronics Corporation, Suwon (KR)

( * ) Notice: Subject to any disclaimer, the term of this patent is extended or adjusted under 35 U.S.C. 154(b) by 217 days.

(21) Appl. No.: 10/749,720

(22) Filed: Dec. 31, 2003

(65) Prior Publication Data

US 2005/0141924 A1 Jun. 30, 2005

(51) Int. Cl.
*G03G 15/10* (2006.01)

(52) U.S. Cl. ..... 399/237; 399/239; 399/249

(58) Field of Classification Search ..... 399/237–239, 399/249

See application file for complete search history.

(56) References Cited

U.S. PATENT DOCUMENTS

| | | | | |
|---|---|---|---|---|
| 5,650,253 | A | 7/1997 | Baker et al. | |
| 5,907,754 | A | 5/1999 | Kim et al. | |
| 5,999,778 | A * | 12/1999 | Chang et al. | 399/237 |
| 6,205,312 | B1 | 3/2001 | Kim | |
| 6,321,053 | B1 * | 11/2001 | Shindo | 399/237 |
| 6,445,898 | B1 * | 9/2002 | Chang et al. | 399/249 |
| 6,512,907 | B1 * | 1/2003 | Nishikawa | 399/249 |
| 6,519,435 | B1 * | 2/2003 | Park et al. | 399/237 |
| 6,650,856 | B1 * | 11/2003 | Ahn et al. | 399/237 |
| 6,778,800 | B1 * | 8/2004 | Shim et al. | 399/249 |
| 2002/0110390 | A1 | 8/2002 | Park et al. | |
| 2003/0161667 | A1 | 8/2003 | Park et al. | |

OTHER PUBLICATIONS

European Search Report dated Apr. 19, 2005.

* cited by examiner

*Primary Examiner*—William J. Royer
(74) *Attorney, Agent, or Firm*—Kagan, Binder PLLC

(57) ABSTRACT

An electrostatic transfer type liquid electrophotographic printer which has a photoreceptor web having a charged surface and opposing back surface, at least one exposing unit for forming a latent electrostatic image onto the charged surface of the photoreceptor web, and at least one development unit for developing the latent electrostatic image on the photoreceptor web into a toner image, wherein each development unit has a developer roller, a toner removal roller, and a squeeze roller, and a backup roller corresponding to at least one of the developer roller, toner removal roller, and squeeze roller, and wherein the photoreceptor web is arranged to provide at least 1 degree of contact wrap around at least one of the backup rollers. The printer further includes an electrostatic transfer unit for transferring the toner images formed in each development unit from the photoreceptor web to a print medium by electrostatic force.

17 Claims, 6 Drawing Sheets

ELECTROSTATIC TRANSFER TYPE LIQUID ELECTROPHOTOGRAPHIC PRINTER USING A CONTINUOUS PHOTORECEPTOR WEB AS A PHOTORECEPTOR MEDIUM

TECHNICAL FIELD

The present invention relates to a liquid electrophotographic printer and, more particularly, to an electrostatic transfer type liquid electrophotographic printer adopting a photoreceptor web as a photoreceptor medium.

BACKGROUND OF THE INVENTION

Electrophotographic printers such as laser printers output a desired image by forming a latent electrostatic image on a photoreceptor medium such as a photoreceptor drum or electroreceptor web, and developing the latent electrostatic image with a predetermined color toner. Electrophotographic printers are classified into a dry type or liquid type according to the toner used. For the liquid type printer, which uses an ink containing liquid carrier and solid toner in a predetermined ratio, it is relatively easy to implement a color image with excellent print quality, compared with the dry type printer which uses solid toner. Electrophotographic printers are also generally classified into an adhesive transfer type and electrostatic transfer type according to the toner image transfer manner. To the adhesive transfer type, after drying a toner image, a transfer roller hot presses the dried toner image such that the image is transferred to a printer paper. The electrostatic transfer type printer transfers a toner image to a print paper by electrostatic forces.

FIG. 1 shows an example of a conventional electrostatic transfer type liquid electrophotographic printer, which adopts photoreceptor drums 10*a*, 10*b*, 10*c* and 10*d* as photoreceptor media. As shown in FIG. 1, this printer has a plurality of image forming units 1*a*, 1*b*, 1*c* and 1*d* for developing and transferring a predetermined color image to a print paper P. For a color printer, the four image forming units 1*a*, 1*b*, 1*c* and 1*d* for a color image development and transfer are arranged in a line in the direction of transferring the print paper P such that toner images are sequentially developed into four colors, yellow (Y), magenta (M), cyan (C), and black (K) to form a multi-color image. Reference numeral 2 denotes a feed belt 2 for feeding the print paper P.

The image forming units 1*a*, 1*b*, 1*c* and 1*d* include photoreceptor drums 10*a*, 10*b*, 10*c* and 10*d* on the surface of which a latent electrostatic image is to be formed, main chargers 20*a*, 20*b*, 20*c* and 20*d* adjacent to the corresponding photoreceptor drums 10*a*, 10*b*, 10*c* and 10*d* to charge the surfaces of the photoreceptor drums 10*a*, 10*b*, 10*c*, and 10*d* to a predetermined potential, and laser scanning units (LSUs) 30*a*, 30*b*, 30*c* and 30*d* which scan light beams onto the surfaces of the respective photoreceptor drums 10*a*, 10*b*, 10*c* and 10*d* to form a latent electrostatic image thereon. Development units 50*a*, 50*b*, 50*c* and 50*d* that develop the latent electrostatic images into toner images with a predetermined color ink are installed below the respective photoreceptor drums 10*a*, 10*b*, 10*c* and 10*d*. Transfer chargers 70*a*, 70*b*, 70*c* and 70*d* which transfer the developed toner images formed on the respective photoreceptor drums 10*a*, 10*b*, 10*c* and 10*d* to a print paper P by electric force are spaced a predetermined distance apart from the surface of the corresponding facing photoreceptor drums 10*a*, 10*b*, 10*c* and 10*d*.

The structure of the development units 50*a*, 50*b*, 50*c* and 50*d* will be described with reference to the development unit 50*a* for yellow (Y) toner image (referred to as Y-development unit 50*a*). Referring to FIG. 2, a developer roller 51, a squeeze roller 52 and a setting roller 53 are installed in the Y-development unit 50*a*. An ink supply unit 57 for supplying an ink to the developer roller 51 is installed adjacent to the developer roller 51. Scrapers 54, 55 and 56 are attached to the lower portion of the developer roller 51, the squeeze roller 52 and the setting roller 53, respectively, to scrape off the ink adhering to the surface of the corresponding rollers.

Development of a Y-toner image by the Y-development unit 50*a* having the configuration above will be described in greater detail. First, as the surface of the photoreceptor drum 10*a* charged to a predetermined potential by the main charger 20*a* and is irradiated by a light beam from the LSU 30*a*, a latent electrostatic image corresponding to the yellow color is formed. The developer roller 51 of the Y-development unit 50*a* rotates counterclockwise while being separated by a predetermined distance from the photoreceptor drum 10*a*. As ink is supplied to the rotating developer roller 51 from the ink supply unit 57, the ink is carried to the gap between the photoreceptor drum 10*a* and the developer roller 51 by the rotation of the developer roller 51. The toner particles of the ink adhere to the latent electrostatic image formed on the photoreceptor drum 10*a*, so that a toner image is formed. At this time, the surface of the developer roller 51 is charged to a predetermined development potential such that the toner selectively adheres to only the latent electrostatic image, not to a non-image region.

The squeeze roller 52 removes excess liquid carrier from the photoreceptor drum 10*a* while being separated by a predetermined distance from the photoreceptor drum 10*a* and rotating clockwise. The setting roller 53 rotates counterclockwise while being separated by a predetermined distance from the photoreceptor drum 10*a*, and creates an electric field between the photoreceptor drum 10*a* and the setting roller 53 with application of a predetermined voltage. The binding force between toner particles becomes strengthened by the electric field produced between the setting roller 53 and the photoreceptor drum 10*a*. Adhesiveness of the toner image to the photoreceptor drum 10*a* also increases. As a result, although an excessive amount of liquid carrier remains on the surface of the photoreceptor drum 10*a* for a subsequent electrostatic transfer, the shape and location of the toner image can be kept intact.

Once the toner image is set by the setting roller 53, the toner image is transferred to a print paper P by the electric field produced by the transfer charger 70*a* to which a potential is applied such that the transfer charger 70*a* is charged to the opposite polarity to the toner.

After a Y-toner image is transferred to the print paper P by the Y-image forming unit 1*a*, a magenta (M)-toner image is developed and transferred to the print paper P by the M-image forming unit 1*b*. As previously described, four toner images in Y, M, C and K are sequentially transferred to a predetermined area on the print paper P fed by the feed belt 2 in accordance with the print paper feed rate, so that a color image is printed on the print paper P. Because a large amount of liquid carrier remains on the resulting color image, a drying process is performed by a drying unit (not shown).

The conventional electrostatic transfer type liquid electrophotographic printer having the configuration described above has the following drawbacks. First, since the conventional printer uses four photoreceptor drums as photoreceptor media, each for a particular color toner image, the multi-color toner images on the four photoreceptor drums must be sequentially transferred to a moving print paper with a predetermined time gap. The respective color toner images are separately transferred, and thus it is difficult to accurately transfer each of the color toner images in a particular area on the print paper in accordance with the print paper feed rate. In other words, an accurate registration control on the development and transfer processes performed by each image-forming unit is difficult.

Second, four toner image transfer processes are carried out on a print paper fed by a feed belt, so that the print paper contacts the liquid carrier adhering to the surface of the photoreceptor drums four times. As a result, unnecessary consumption of the liquid carrier increases and the wetness of the print paper also increases.

Third, because the squeeze roller removes liquid carrier in a non-contact manner with respect to the photoreceptor drums, the amount of the liquid carrier remaining on the surface of the photoreceptor drums is nonuniform for all the image forming units. As a result, toner image transfer efficiency differs from color to color. It is therefore desirable to provide an electrostatic transfer type liquid electrophotographic printer for applying multiple colors to print paper that overcomes the drawbacks discussed above.

SUMMARY OF THE INVENTION

In one aspect of this invention, an electrostatic transfer type liquid electrophotographic printer is provided, which generally includes a photoreceptor web, at least one exposing unit, at least one development unit, and an electrostatic transfer unit. More particularly, the electrophotographic printer of the present invention preferably includes a continuous photoreceptor web having a charged surface and an opposing back surface, wherein the web rotates around a printing path. The printer further preferably includes at least one laser scanning unit for scanning a light beam onto the charged surface of the photoreceptor web to form a latent electrostatic image and at least one development unit for developing the latent electrostatic image on the photoreceptor web into a toner image with an ink containing a liquid carrier and charged toner particles, wherein each development unit preferably includes a developer roller, a toner removal roller, a squeeze roller, a developer backup roller, a toner removal backup roller, and a squeeze backup roller. The photoreceptor web is arranged to provide at least 1 degree of contact wrap around at least one of the backup rollers that correspond to the developer roller, the toner removal roller, and the squeeze roller. The electrostatic transfer unit of the electrophotographic printer preferably provides for transferring the toner images formed in each development unit from the photoreceptor web to a print medium by electrostatic force.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
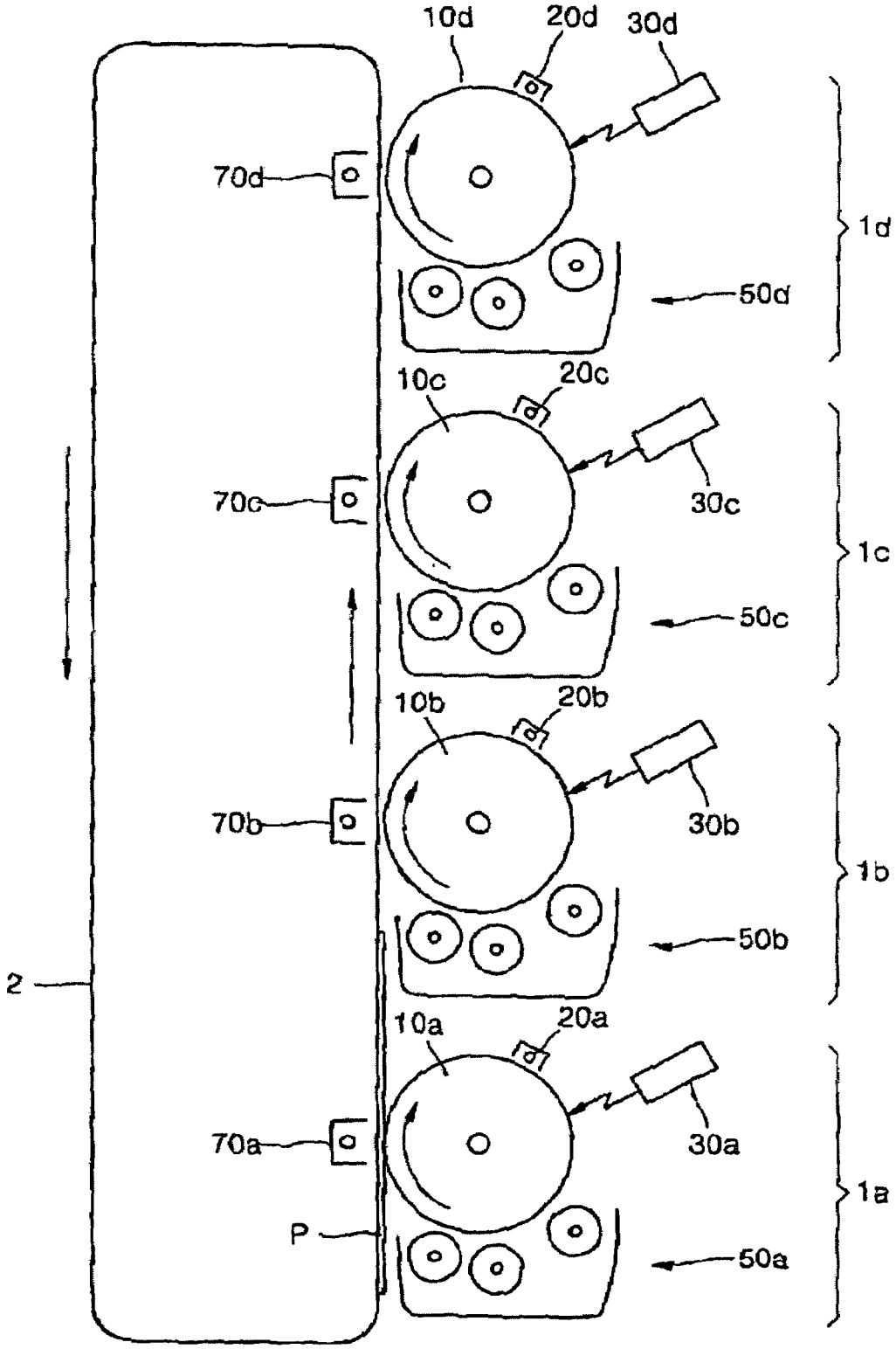
FIG. 1 (PRIOR ART)
FIG. 1 is a schematic view of one representative system of the liquid electrophotographic apparatus of the prior art.
Figure 2:
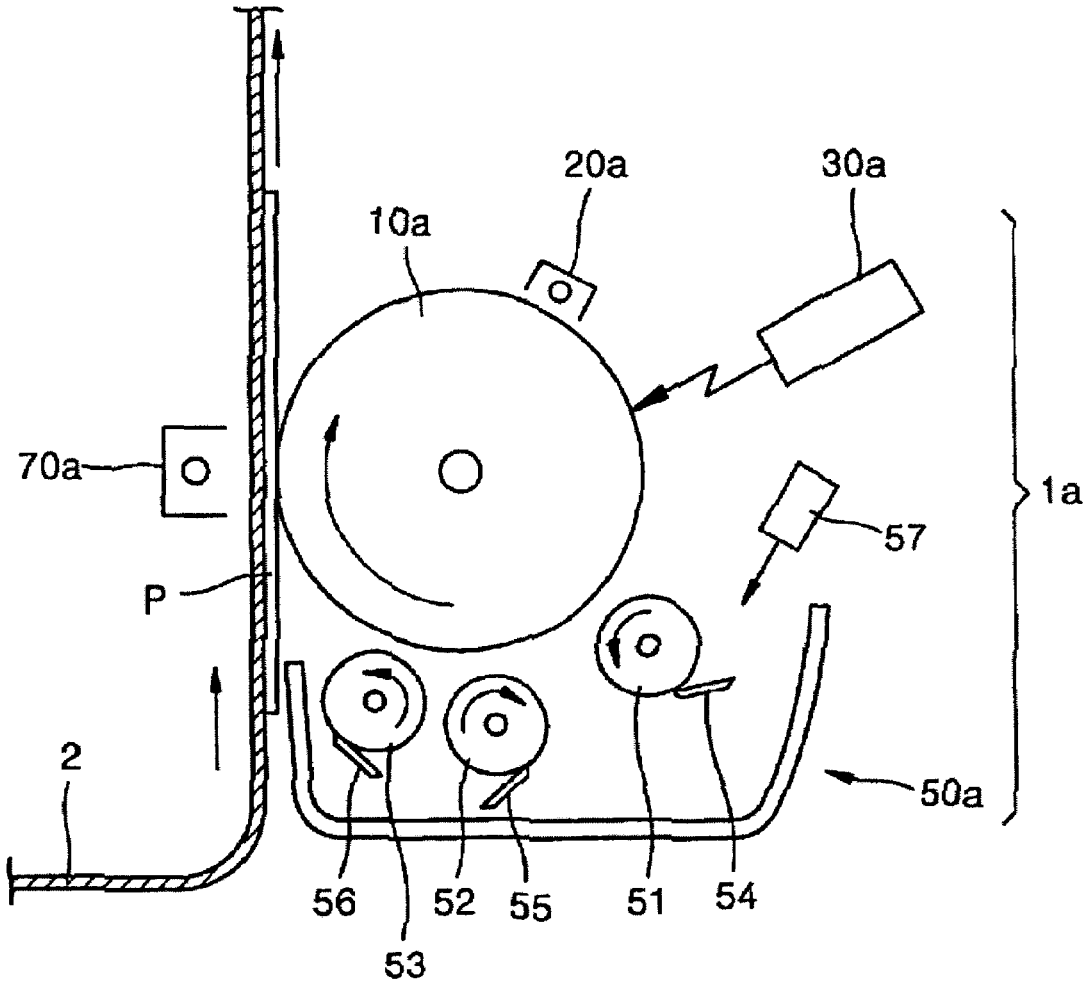
FIG. 2 (PRIOR ART)
FIG. 2 is a schematic view of one development unit of the apparatus of FIG. 1.
Figure 3:
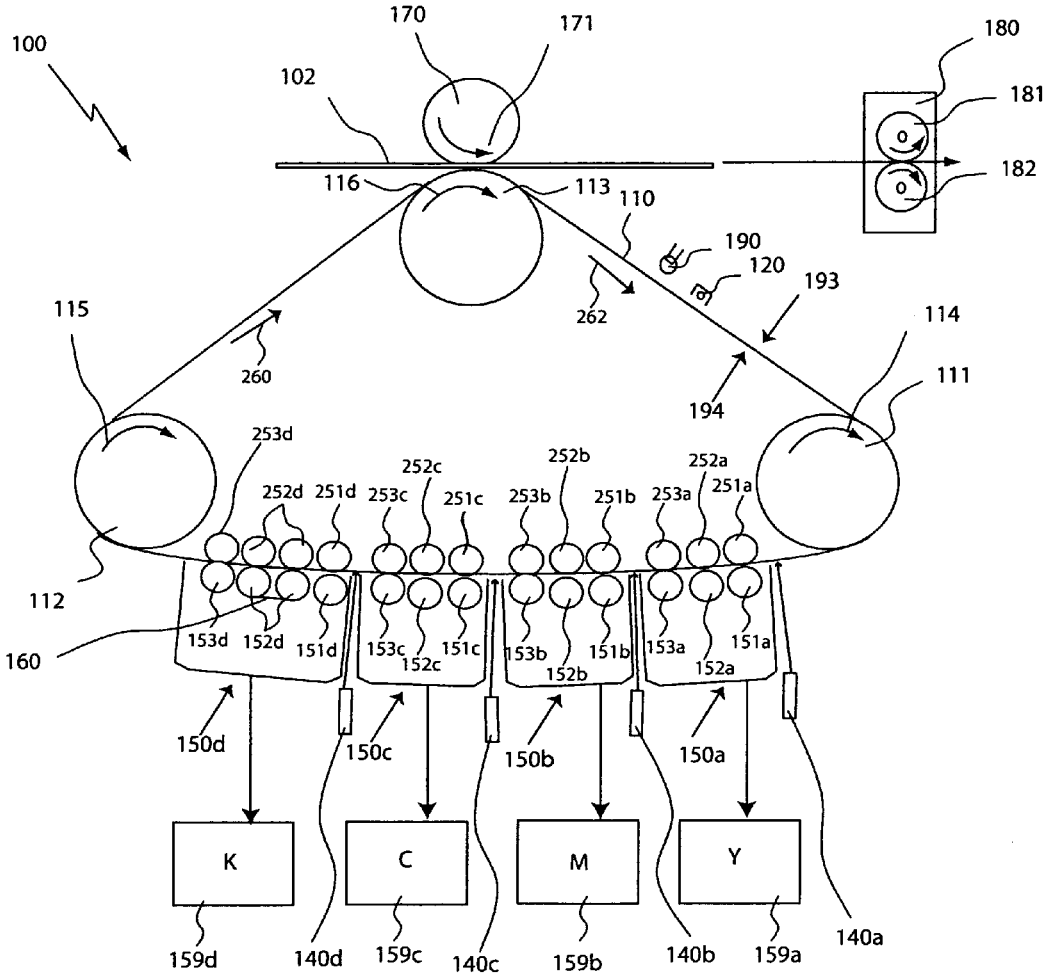
FIG. 3 is a schematic view of a liquid electrophotographic apparatus of the present invention, including a backup roller corresponding to each roller in each developer unit, a partial mechanical wrap of the photoreceptor web around each backup roller, and the effect that this mechanical wrap has on the design of the machine, namely, the "arc" of the photoreceptor frame.

Referring now to the Figures, wherein the components are labeled with like numerals throughout the several Figures, and initially to FIG. 3, one preferred configuration of an electrostatic transfer type liquid electrophotographic printer 100 is illustrated, in accordance with the present invention. This printer 100 generally uses a photoreceptor web 110 circulating around a continuous path as a photoreceptor medium. This configuration includes aspects of the transfer type liquid electrophotographic printer of the type described in United States Patent Application Publication No. 2002/0110390, the entire contents of which are incorporated herein by reference.

As shown in FIG. 3, the electrostatic transfer type liquid electrophotographic printer 100 utilizes a photoreceptor web or belt 110 as a photoreceptor medium. The photoreceptor web 110 is preferably supported by three rollers 111,112 and 113, including a driving roller and a steering roller. In the preferable embodiment, roller 111 is a driving roller and roller 112 is a steering roller; however, it is possible that roller 112 is a driving roller and roller 111 is a steering roller, or it is also possible that other driving and/or steering rollers are included in the printer configuration. Roller 113 may be referred to as a transfer backup roller, as this is the roller against which transfer of an image from the photoreceptor web 110 to a print paper 102 occurs. This roller 113 is preferably biased in order to effect electrostatic transfer of an image to print paper 102 or other medium. The photoreceptor web 110 circulates or moves around a continuous path or loop that is defined by the outer surfaces of the rollers 111, 112, and 113. The arrows 114, 115, and 116 show the direction of rotation of the rollers 111, 112, and 113, respectively, which roller rotation effects the movement of the photoreceptor web 110 in the direction indicated by arrows 260 and 262. Alternatively, the rollers 111, 112, and 113 could all rotate in the opposite direction to cause the photoreceptor web 110 to move in the opposite direction; however, this would require repositioning of at least some of the other system components relative to the location of other components in the system. Additional or different rollers may be provided within the system, as desired, which would thereby change the path of the photoreceptor web 110 needed to encircle these rollers in a similar manner to that shown in FIG. 3.

A main charger 120 is shown adjacent to the photoreceptor web 110 to uniformly charge the photoreceptor web 110 to a predetermined potential. As shown, main charger 120 is located between the rollers 113 and 111 so that the photoreceptor web 110 can be charged to a particular potential before being exposed to the components of the system that provide ink to the photoreceptor web 110, as described below. The main charger 120 is preferably sized and positioned so that it can sufficiently charge the photoreceptor web 110 to allow an electrostatic image to be formed thereon by at least one development unit. It is possible that additional chargers are provided (not shown), such as before the photoreceptor web 110 reaches some or all of laser scanning units 140*a*, 140*b*, 140*c* and/or 140*d*. It is also possible that squeeze rollers 153*a*, 153*b*, 153*c* and/or 153*d* of development units 150*a*, 150*b*, 150*c* and/or 150*d* described below are sufficiently biased to charge the photoreceptor web 110 periodically through the process. In any case, it is preferable that the photoreceptor web 110 is recharged in the development units 150*a*, 150*b*, 150*c*, and 150*d* after each color is provided to the photoreceptor web 110.

Laser scanning units (LSUs) 140*a*, 140*b*, 140*c* and 140*d* and development units 150*a*, 150*b*, 150*c* and 150*d* are preferably provided below the photoreceptor web 110 (i.e., to contact the front surface 193 of the photoreceptor web 110) and between the rollers 111 and 112. The LSUs 140*a*, 140*b*, 140, and 140*d* are used for scanning light beams onto the charged photoreceptor web 110 to form a latent electrostatic image, and development units 150*a*, 150*b*, 150*c* and 150*d* are used for developing the latent electrostatic image as a toner image, each with a predetermined color ink. To form a multi-color image, for example, an electrophotographic printer would preferably be provided with four ink reservoirs 159*a*, 159*b*, 159*c*, and 159*d*, each containing one of the ink colors of yellow (Y), magenta (M), cyan (C) and black (B), four LSUs 140*a*, 140*b*, 140*c* and 140*d*, and four development units 150*a*, 150*b*, 150*c* and 150*d*. With these components, toner images of four different colors can be sequentially formed, overlapping or overlying each other, and developed into a multi-color image. As shown, the four development units 150*a*, 150*b*, 150*c* and 150*d* are arranged sequentially below the photoreceptor web 110 with their respective rollers in a rotation movement or circulation direction of the photoreceptor web 110. The structure and operation of the development units 150*a*, 150*b*, 150*c* and 150*d* will be described later in greater detail.

In a lower portion of the respective development units 150*a*, 150*b*, 150*c* and 150*d*, ink reservoirs 159*a*, 159*b*, 159*c* and 159*d*, which contain Y, M, C and K inks, respectively, are provided. Toner charged to a predetermined polarity is dispersed in a liquid carrier in the inks contained in the ink reservoirs 159*a*, 159*b*, 159*c* and 159*d*. The concentration of ink is preferably in the range of about 2.0–3.0%, and more preferably about 2.5%, where the term "concentration" refers to the weight percentage of toner solids with respect to carrier liquid. Although it is understood that the present invention is equally applicable to systems where the toner is charged to either a positive or negative potential, the description below is directed to the toner being charged to a positive potential. When the toner is charged to a negative potential, the opposite charging of other components and processes described below (that refer to charges of a positive potential) will be used. In addition, the four color toner images may be developed in an order that is different from the preferable order of Y, M, C, and then K, as described above, such as in the order of Y, C, M, and then K, for example.

After the image comprising at least one color is formed on the photoreceptor web 110 (i.e., the photoreceptor web 110 has passed by the development units 150*a*, 150*b*, 150*c*, and 150*d*, at least one of which has provided ink to the photoreceptor web 110), the image may then be transferred to a piece of paper or other final image receptor. In this configuration, a print paper 102 is shown adjacent to the roller 113 for accepting the image from the photoreceptor web 110. In many cases, it may be possible to achieve more than 99% transfer efficiency at an ink solids concentration of 20–40%. In other words, the percentage of the toner images transferred from the photoreceptor web 110 to a print paper 102, or the "transfer efficiency", may be higher than 99% at a concentration of 20–40%. If the toner concentration is relatively high (e.g., exceeds 40% by weight), the electrostatic transfer process may be more difficult to perform due to reduced fluidity of the toner, thereby lowering transfer efficiency. If the toner concentration is relatively low (e.g., below 20% by weight) and the liquid carrier content is too high, toner image leaking may occur on the print paper 102 due to highly increased fluidity of the toner. In addition, when the toner concentration is relatively low, it is less likely that the toner images can be kept intact before being transferred to a print paper 102. If the toner concentration is relatively high (e.g., above 40% by weight), the electrostatic transfer process may become more difficult or impossible; however, it may be possible to successfully transfer the image using adhesive transfer with certain temperatures and pressures, as desired.

The toner images developed on the surface of the photoreceptor web 110, whose toner concentration has preferably been adjusted to be suitable for electrostatic transfer, can be transferred to the print paper 102 by an electrostatic transfer unit. Such an electrostatic transfer unit forms an electric field between the photoreceptor web 110 and the electrostatic transfer unit so that the toner images formed on the photoreceptor web 110 are transferred to the print paper 102 by the electric force. As shown in FIG. 3, an electrostatic transfer roller 170 may be used as the electrostatic transfer unit. The electrostatic transfer roller 170 rotates in a rotation direction 171 while preferably being in contact with the photoreceptor web 110 when no paper is present, although a gap provided between the electrostatic transfer roller 170 and photoreceptor web 110 is possible. When the print paper 102 is fed between the electrostatic transfer roller 170 and the photoreceptor web 110, the electrostatic transfer roller 170 will then be in contact with the print paper 102. To create an electric field, a predetermined voltage of 900V–2 kV, for example, is preferably applied to the electrostatic transfer roller 170. It is noted, however, that the polarity of the transfer voltage is determined based on the polarity of the ink particles. The surface of the electrostatic transfer roller 170 is preferably formed of a resistive material having a high resistance of $10^8$–$10^9$ ohms, for example. One possible material from which the electrostatic transfer roller 170 may be made is conductive urethane rubber, or may include a roller made of multiple materials, such as a roller comprising an inner core made of a material such as steel and having an outer coating of urethane rubber, for example. The reason that a voltage having the opposite polarity to the toner is applied to the electrostatic transfer roller 170 is to attract the toner such that a toner image can be transferred to the print paper 102.

A fusing unit 180 for fusing the toner images transferred to the print paper 102 may be provided at the paper eject side of the electrostatic transfer roller 170. The fusing unit 180 may include two or more fusing rollers 181 and 182 rotating in opposite directions and in contact with each other until a print paper 102 or other transfer medium is introduced between the fusing rollers 181 and 182 for fusing. The fusing rollers 181 and 182 fix the toner images on the print paper 102, which passes between the fusing rollers 181 and 182, by hot pressing. The printer 100 may further include an eraser unit 190 for removing the remaining latent electrostatic images from the surface of the photoreceptor web 110.

Hereinafter, the development units 150*a*, 150*b*, 150*c* and 150*d* will be described in greater detail. In the embodiment illustrated in FIG. 3, the three development units 150*a*, 150*b* and 150*c*, exclusive of the K-development unit 150*d* (a development unit for black (K)), preferably have generally the same structure. A concentration control unit 160 can optionally be installed in the K-development unit 150*d*, thereby making the structure of this development unit different from the structure of the others. If such a concentration control unit is not used, the structure of the K-development unit 150*d* may be the same as the other development units 150*a*, 150*b*, and 150*c*, with a single roller replacing the two rollers 152*d* shown in K-development unit 150*d*. The structure of the three development units 150*a*, 150*b* and 150*c*, which are preferably the same, will be described first with reference to the Y-development unit 150*a* (a development unit for yellow (Y)) of FIG. 4.

Figure 4:
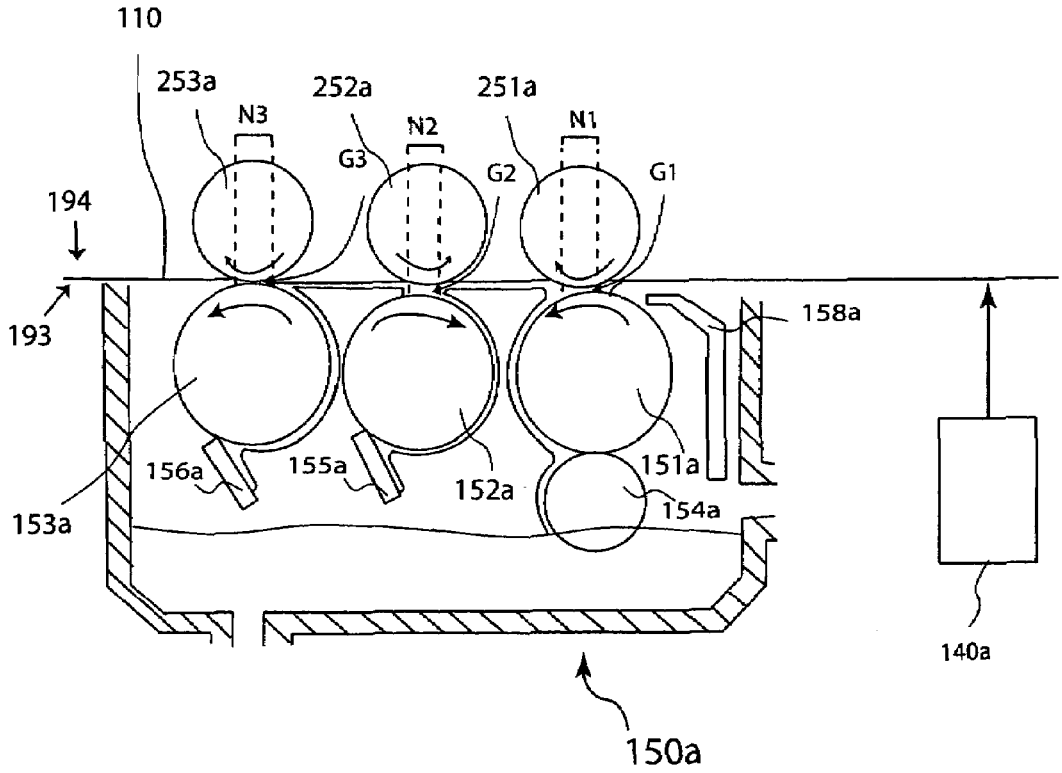
FIG. 4 is a schematic view of one development unit of the system of FIG. 3, including backup rollers and a mechanical wrap of a photoreceptor web relative to those rollers.

Referring additionally to FIG. 4, which shows components of the development unit 150*a* that are not shown in FIG. 3 (for clarity purposes), three rollers including a developer roller 151*a*, a toner removal roller 152*a*, and a squeeze roller 153*a* are installed in an upper portion of the Y-development unit 150*a*. This embodiment of the electrostatic transfer type liquid electrophotographic printer 100 according to the present invention employs a development system that preferably uses these three rollers 151*a*, 152*a* and 153*a*. It is contemplated, however, that a different number of rollers and/or rollers having different functions could be used. In this embodiment, the developer roller 151*a* is used to make the toner particles of the ink adhere to the latent electrostatic images formed in an image region of the photoreceptor web 110 to form toner images. The toner removal roller 152*a* is used to remove the toner adhering to the non-image region of the photoreceptor web 110. To this end, a predetermined voltage is preferably applied to the toner removal roller 152*a*, as will be described in further detail below. The squeeze roller 153*a* is used to press a portion of the photoreceptor web 110 in which toner images are formed to squeeze excess liquid carrier from the portion, thereby aggregating the toner particles forming the toner images. A relatively high voltage is preferably applied to the squeeze roller 153*a* so that the photoreceptor web 110 can be charged by the squeeze roller 153*a* to a predetermined potential for another color toner image development. To this end, at least the surface of the squeeze roller 153*a* is preferably formed of a resistive material with a high resistance of $10^5$–$10^7$ ohms, and more preferably, $10^6$ ohms (e.g., urethane rubber).

An ink supply nozzle 158*a* is preferably installed adjacent to the developer roller 151*a*. This ink supply nozzle 158*a* supplies the ink contained in the Y-ink reservoir 159*a* (see FIG. 3) in the gap between the photoreceptor web 110 and the developer roller 151*a*. A cleaning roller 154*a* rotating in contact with the developer roller 151*a* may be installed below the developer roller 151*a* for removing the ink adhering to the surface of the developer roller 151*a*. A blade 155*a* is preferably disposed underneath the toner removal roller 152*a*, while one of its ends is in contact with the surface of the toner removal roller 152*a*. A blade 156*a* is preferably disposed underneath the squeeze roller 153*a*, while one of its ends is in contact with the surface of the squeeze roller 153*a*. The two blades 155*a* and 156*a* act to remove the ink or liquid carrier adhering to the surface of the toner removal roller 152*a* and the squeeze roller 153*a*, respectively. As the cleaning means, the cleaning roller 154*a* and the blades 155*a* and 156*a* are interchangeable. In other words, either one or both of a cleaning roller and a blade may be installed for each of the rollers 151*a*, 152*a* and 153*a*.

Continuing to refer to FIGS. 3 and 4, each of the developer rollers 151*a*, 152*a*, 153*a* is preferably provided with a corresponding backup roller 251*a*, 252*a*, 253*a*, respectively. The backup rollers 251*a*, 252*a*, 253*a* are positioned to be adjacent to the back side 194 of the photoreceptor web 110, and are positioned to press snugly against the photoreceptor web 110, creating a mechanical wrap that is preferably at least about 1 degree around each backup roller 251*a*, 252*a*, 253*a*. This wrap of the photoreceptor web 110 can be selected and controlled through the positioning of the various rollers in the development units 150*a*, 150*b*, 150*c*, and 150*d* to create a relatively continuous "arc" or curve of the photoreceptor web 110 from the general area of roller 111 to the general area of roller 112. The arc or curve preferably extends from the first development roller that the photoreceptor web 110 passes (e.g., roller 151*a*) to the last development roller that the photoreceptor web 110 passes (e.g., roller 153*d*) of the multiple development units 150*a*, 150*b*, 150*c*, and 150*d*. In addition, while a mechanical wrap of at least about 1 degree on all of the rollers is preferable, the wrap angle may be different with respect to some of the rollers, where the wrap for some of the rollers is above 1 degree and the wrap on other rollers is less than 1 degree, for example. However, the degree of wrap on any of the rollers should be greater than 0 degrees, in accordance with the present invention.

The application of backup rollers in this system that press firmly enough against the backside 194 of the photoreceptor web 110 to form such a mechanical wrap around at least some of the backup rollers is advantageous in that the critical gaps between the rollers and photoreceptor web 110 can be more easily established and maintained. The developer rollers 151*a*, 152*a*, 153*a* and backup rollers 251*a*, 252*a*, 253*a* have diameters that are chosen with a preferable nip width $N_1$, $N_2$, $N_3$ in mind. The pairs (151*a* and 251*a*; 152*a* and 252*a*) of rollers are each carefully spaced to provide precise gap distances $G_1$ and $G_2$ between the roller 151*a* and the web 110 and between the roller 152*a* and the photoreceptor web 110, respectively. In particular, the gap $G_1$ between the roller 151*a* and the photoreceptor web 110 is preferably maintained at a certain distance to facilitate electrostatic transfer of charged toner pigment particles to the photoreceptor web 110. If this gap $G_1$ is too large, a sufficient portion of the toner might not transfer to the photoreceptor web 110, thereby causing poor printing quality. If the gap $G_1$ is too small, the transfer of toner might transfer to the photoreceptor web 110 by a different process than electrostatic transfer, which might also cause poor printing quality. Further, the gap $G_2$ between the roller 152*a* and the photoreceptor web 110 is preferably maintained at a certain distance so that the thickness of the toner or "toner patch" can be properly controlled or metered. Thus, if the gap $G_2$ is too large, the toner will be thicker than desired and if the gap $G_2$ is too small, the toner will be thinner than desired, wherein both thickness variations can detrimentally effect the quality of the toner image that remains on the photoreceptor web 110. In any case, the printer 100 may further include additional cleaning means to remove any residual ink from the photoreceptor web 110 after transfer of the toner images.

Additionally, the backup roller 253*a* against which the squeeze roller 153*a* can press may be selected to be a heavier roller having reduced flexibility, such that an increased force may be uniformly distributed along the nip $N_3$. When the backup roller 253*a* is a heavier roller, the roller may impart a force that is preferably between about 1 kg and 15 kg, and more preferably between about 5 kg and 10 kg. However, in the case of electrostatic transfer processes, the amount of force required in the nip $N_3$ to squeeze excess carrier from the image would typically be minimal. Preferably, the pressure across the width of this nip $N_3$ is relatively consistent across the entire width of the rollers, and it is further preferable that the amount of pressure applied is adjustable, as desired.

With respect to the rollers of the development unit 150*d*, the provision of backup rollers is similar to that described above relative to the development units 150*a*, 150*b*, and 150*c*, except that when a concentration control unit 160 is used, each of the two rollers 152*d* of the concentration control unit is preferably provided with its own corresponding backup roller 252*d*. In this way, pressure may be placed on the rollers of the development unit 150*d* in the same manner as described for the other development units. Thus, for each roller in each developer unit (151*a*, 152*a*, 153*a*, 151*b*, 152*b*, 153*b*, 151*c*, 152*c*, 153*c*, 151*d*, 152*d*, 153*d*) there is preferably a corresponding backup roller (251*a*, 252*a*, 253*a*, 251*b*, 252*b*, 253*b*, 251*c*, 252*c*, 253*c*, 251*d*, 252*d*, 253*d*, respectively) pressed against the backside 194 of the photoreceptor web 10 with a mechanical wrap of preferably at least 1 degree around each backup roller. In the embodiment shown, certain pairs of rollers have a carefully selected gap between them (151*a* and 251*a*; 152*a* and 252*a*; 151*b* and 251*b*; 152*b* and 252*b*; 151*c* and 251*c*; 152*c* and 252*c*; 151*d* and 251*d*; 152*d* and 252*d*), as described above. Some of the pairs of rollers (e.g., 153*a* and 253*a*; 153*b* and 253*b*; 153*c* and 253*c*; 153*d* and 253*d*) may not have a gap between them. Rather, the squeeze rollers (153*a*, 153*b*, 153*c*, and/or 153*d*) may actually contact the front surface 193 of the photoreceptor web 110 at the same time that the corresponding backup rollers (253*a*, 253*b*, 253*c*, and/or 253*d*) contact the back surface 194 of the photoreceptor web 110.

Figure 6:
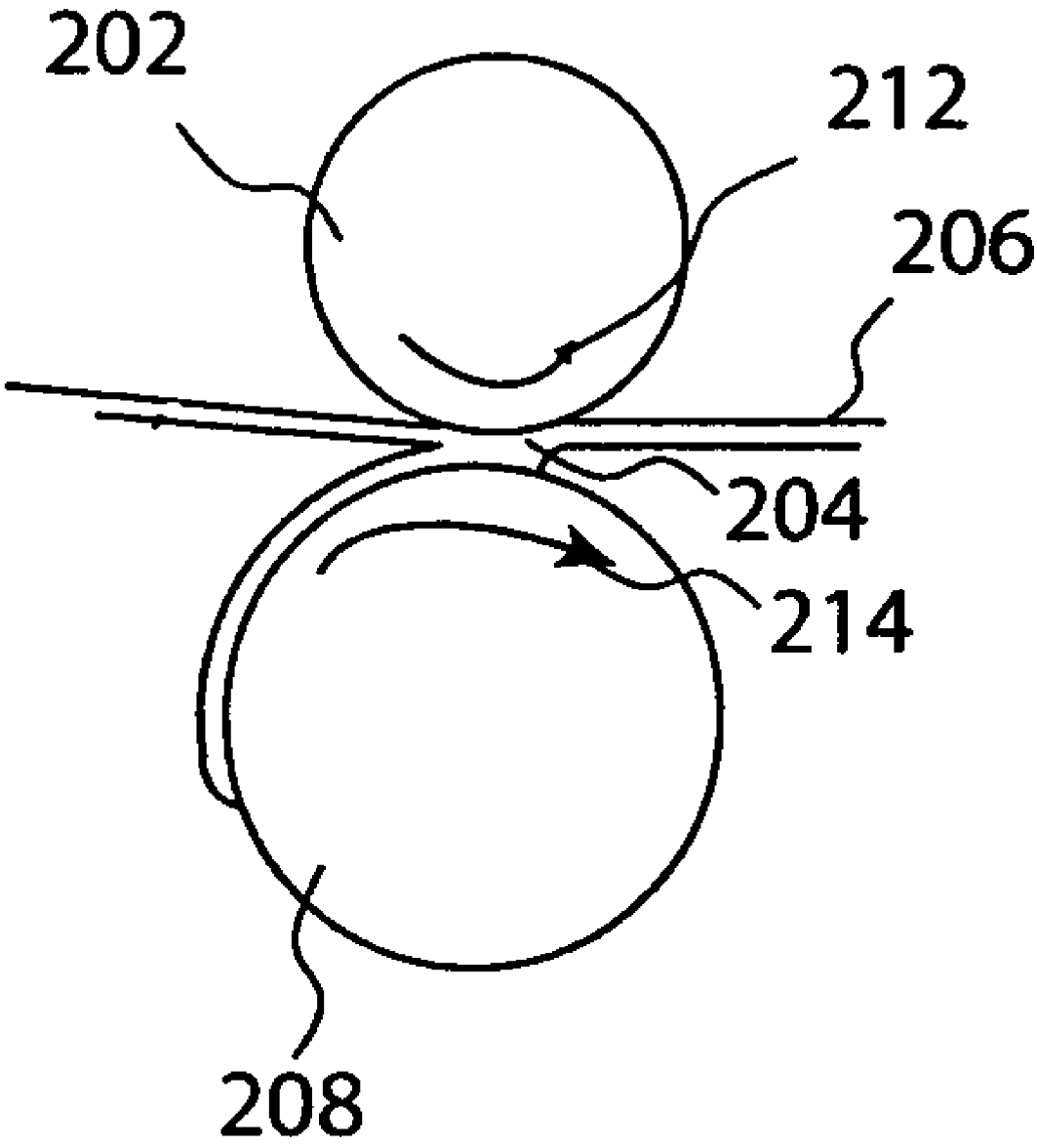
FIG. 6 is a schematic view of a back up roller positioned relative to a roller of a development unit of the liquid electrophotographic apparatus.

Referring also to FIG. 6, a representative roller 208 of a development unit is shown (which has a similar configuration to two paired rollers in one of the development units of a printer of the present invention), along with its corresponding backup roller 202, to illustrate a simplified view of a gap 204 between two rollers. Roller 208 is rotatable in a direction 214 and backup roller 202 is rotatable in an opposite direction 212, as shown. A backup roller, such as roller 202, is preferably provided at each nip area, and is preferably positioned to allow at least about 1 degree of mechanical wrap of the photoreceptor web 206 about its outer surface. This roller 202 can advantageously maintain the gap 204 and the contact nip between the development unit roller 208 and a photoreceptor web 206 at a predetermined, desirable distance. Thus, it is preferable that the rollers of a printer of the present invention are adjustable to maintain the desired gaps, nip sizes, and/or compression forces between rollers and the photoreceptor web, where such adjustability may either be automatic (as may be controlled by electronic measurements and feedback loops, for example) or be manual (as may be adjusted by manual movement of the rollers when it is determined that the print quality can be improved with a change in the size of the gap, for example). In any given pair of rollers (e.g., a developer roller and its corresponding back-up roller), either one or both of the rollers may be adjustable for maintaining the gap size, where moving the back-up roller will typically also change the wrap of the photoreceptor web around that back-up roller, which may also be desirable in some cases. If such a change in the wrap of the photoreceptor web around a particular back-up roller is not desirable, the other roller (e.g., the developer roller) may instead be moved to adjust the size of the gap.

Figure 5:
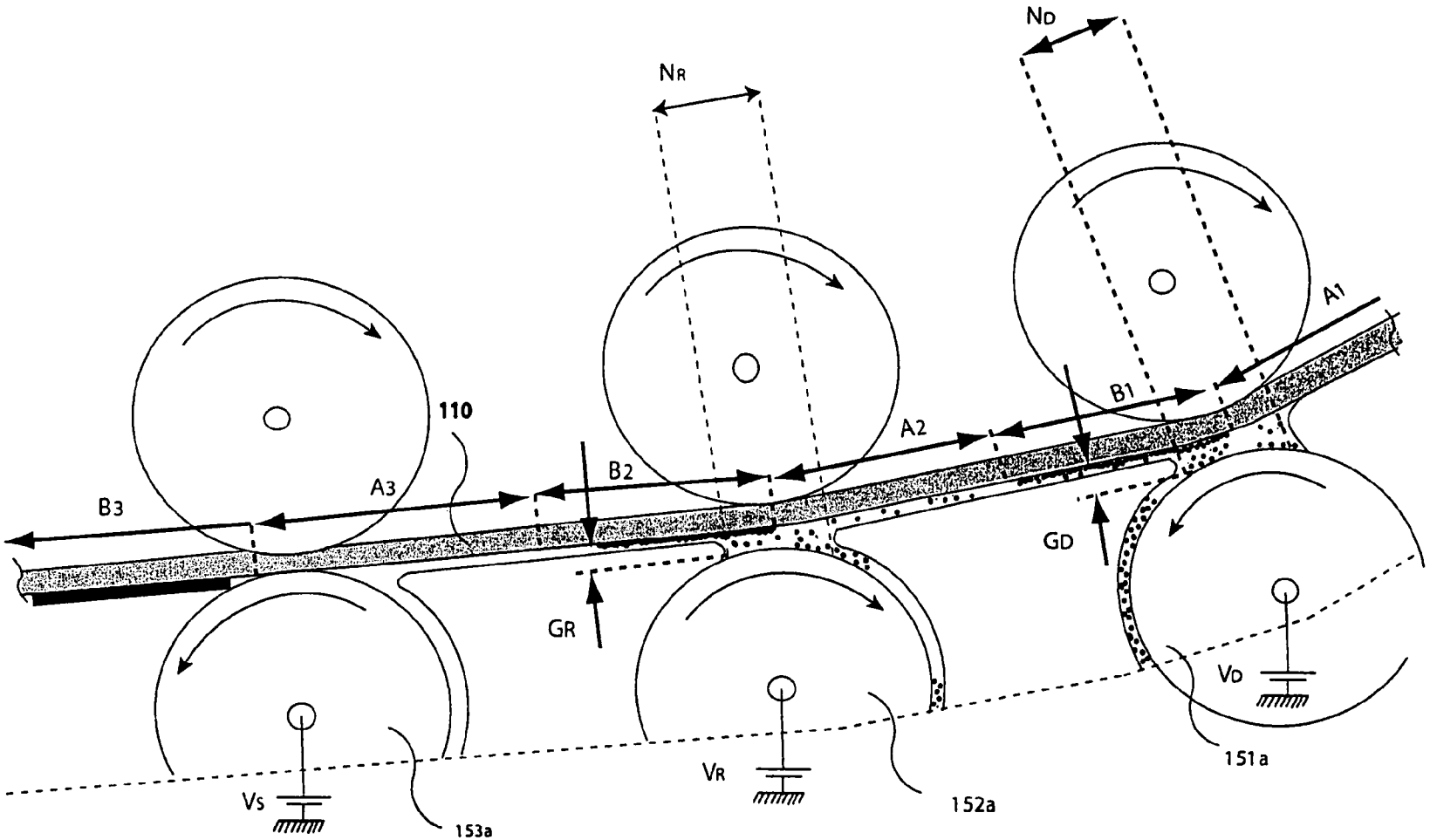
FIG. 5 is a schematic view of one embodiment of the liquid electrophotographic toner transfer process of the present invention.

Development of a latent electrostatic image into a toner image by the Y-development unit 150*a* having the configuration described previously will be further described with reference to FIG. 5, which is a magnified illustration of a portion of the development unit 150*a* of FIG. 4. As described above relative to FIG. 3, before the photoreceptor web 110 reaches the development units 150*a*, 150*b*, 150*c*, and 150*d*, the main charger 120 charges the photoreceptor web 110 to a potential (referred to as a charge potential), for example, of 500–900 volts, and preferably, 550–750 volts, and having the same polarity as the toner. The charged surface of the photoreceptor web 110 is then irradiated by a light beam from the Y-LSU (LSU for yellow) 140*a* so that a latent electrostatic image corresponding to yellow color is formed. The Y-LSU 140*a* selectively discharges the surface of the photoreceptor web 110 to form a latent electrostatic image, so that a potential of the image region $B_1$, in which the latent electrostatic image is formed, drops to about 100 volts or less (referred to as exposure potential), while a potential of the non-image region $A_1$ is maintained at the initial charge potential charged by the main charger 120.

The latent electrostatic image is developed into a Y-toner image by the Y-development unit 150*a*. In particular, as the photoreceptor web 110 passes over the developer roller 151*a*, Y-toner adheres to the image region $B_1$, in which an electrostatic latent image is formed, to form a Y-toner image. As a predetermined voltage is applied to the developer roller 151*a*, the surface of the developer roller 151*a* is charged to a development potential $V_D$ of about 350 volts, for example. The development potential $V_D$ of the development roller 151*a* is determined to be lower than the charge potential (e.g., 550 V) of the non-image region $A_1$, and to be higher than the exposure potential (e.g., 100 V) of the image region $B_1$. It is preferable that differences between the development potential $V_D$ and each of the charge potential and the exposure potential are 100 volts or more, and more preferably, 200 volts or more. As the potential differences become greater, the affinity of toner particles to the photoreceptor web 110 and the developer roller 151*a* becomes more apparent. The developer roller 151*a* rotates in the circulation direction of the photoreceptor web 110 while being separated by a development gap $G_D$(e.g., 150–200 μm) from the photoreceptor web 110. In one example, as an ink contained in the Y-ink reservoir 159*a* containing Y-toner of about 2.5% solids by weight is supplied by the ink supply nozzle 158*a*, a nip $N_D$ as a liquid carrier film having about 6-mm width is formed between the photoreceptor web 110 and the developer roller 151*a*. It is understood that as the weight percent of toner and other variables are changed, the size of any nips and gaps may differ.

In this example, the toner particles of the ink are preferably charged to positive potential and move in the nip $N_D$ as follows. The exposure potential (e.g., 100 volts) in the image region $B_1$ of the photoreceptor web 110 is lower than the development potential (e.g., 350 volts) of the development roller 151*a*, so that the toner particles move toward the image region $B_1$ and adhere to the image region $B_1$. The charge potential (e.g., 550 volts) in the non-image region $A_1$ is greater than the development potential $V_D$ (e.g., 350 volts) of the developer roller 151*a*, so that the toner particles move towards the developer roller 151*a* and adhere to the developer roller 151*a*. In other words, the toner particles selectively adhere to only the image region $B_1$ charged to a relatively low potential, so that toner images are formed therein. Excess ink and toner particles stuck to the surface of the developer roller 151*a* can be removed by a cleaning device such as the cleaning roller 154*a* rotating in contact with the developer roller 151*a*, as previously described.

On the image region $B_2$ corresponding to the image region $B_1$ passed through the developer roller 151*a*, an ink layer of a high-concentration toner image is formed and covered with a liquid carrier layer. On the non-image region $A_2$, only a liquid carrier layer is formed. In the image region $B_2$ passed through the developer roller 151*a*, the potential increases to about 160 volts, for example. The potential in the non-image region $A_2$ would then preferably drop to about 380 volts, for example. It is desirable that no toner remains in the liquid carrier layers passed through the developer roller 151*a*. However, in some situations, some toner (e.g., about 0.5% by weight toner) remains in the liquid carrier layers. The remaining toner particles can be transferred to the M-development unit 150*b* along the photoreceptor web 110, and mixed with toner of another color. As a result, the M-development unit 150*b*, C-development unit 150*c*, and K-development unit 150*d*, which are sequentially arranged, and the inks for each color, can be contaminated by the transfer of toner particles. Thus, there is a need to remove the toner particles remaining in the liquid carrier layers to minimize such contamination.

The toner particles remaining in the liquid carrier layers are preferably removed by the toner removal roller 152*a* disposed adjacent to the developer roller 151*a*. As the photoreceptor web 110 passes the toner removal roller 152*a*, toner particles remaining in the liquid carrier layer in the non-image region $A_2$ are removed, thereby resulting in a toner-free liquid carrier layer in the non-image region $A_2$. In particular, the surface of the toner removal roller 152*a* is preferably charged to a toner removal potential $V_R$ of about 250 volts, for one example, with application of a predetermined voltage. The toner removal potential $V_R$ of the toner removal roller 152*a* is determined to be greater than the exposure potential (e.g., 160 volts) in the image region $B_2$ and lower than the potential (e.g., 380 volts) in the non-image region $A_2$. As a potential difference in each region becomes greater, it is much easier to remove the toner particles from the liquid carrier layer. The toner removal roller 152*a* is installed with a preferable gap $G_R$ of about 150–200 μm, for example, from the photoreceptor web 110. A nip $N_R$ having a width of 3 mm to 5 mm, for example, may be formed between the toner removal roller 152*a* and the photoreceptor web 110. The width of the nip $N_R$ may be varied depending on the diameter of the toner removal roller 152*a* and the size of the gap $G_R$. It is understood that as the weight percent of toner is varied, the size of any nips may differ. Although the toner removal roller 152*a* can rotate in either direction, it is preferable that the toner removal roller 152*a* rotates in an opposite direction from the circulation direction of the photoreceptor web 110 for easier formation of the nip $N_R$.

In one example, in the nip $N_R$ formed between the photoreceptor web 110 and the toner removal roller 152*a*, the toner particles move as follows. In the non-image region $A_2$ of the photoreceptor web 110, the potential (e.g., 380 volts) is higher than the toner removal potential $V_R$(e.g., 250 volts) of the toner removal roller 152*a*, so that toner particles dispersed in the liquid carrier layer can move towards the toner removal roller 152*a*. The potential (e.g., 160 volts) in the image region $B_2$ is lower than the toner removal potential $V_R$(e.g., 250 volts) of the toner removal roller 152*a*, so that the toner particles move towards the image region $B_2$ and adhere to a previously formed toner image. As the toner removal roller 152*a* rotates, a removal device, such as the blade 155*a* of FIG. 4, removes the toner particles and liquid carrier adhering to the surface of the toner removal roller 152*a*.

As described previously, the toner particles existing in the liquid carrier layer on the non-image region $A_2$ can be almost completely removed by the toner removal roller 152*a*, so that a toner-free liquid carrier remains in the non-image region $A_3$ of the photoreceptor web 110 passed through the toner removal roller 152*a*. As a result, the problem of toner transfer to the adjacent development unit can be lessened.

Next, as the photoreceptor web 110 advances to the squeeze roller 153*a*, the squeeze roller 153*a* presses the toner image region of the photoreceptor web 110, so that excess liquid carrier is squeezed from the toner image. In particular, the squeeze roller 153*a* preferably rotates in the circulation direction of the photoreceptor web 110 in contact with the photoreceptor web 110 with a compression force, for example, of about 10 kg. As a result, the liquid carrier covering the toner image in the image region $B_3$ of the photoreceptor web 110, and the liquid carrier adhering to the non-image region $A_3$ are removed so that just an appropriate and desired amount of the liquid carrier remains therein. Once the photoreceptor web 110 passes the squeeze roller 153*a*, a toner image is formed as an ink layer containing, for example, about 50% by weight toner in the image region $B_3$ of the photoreceptor web 110. Any liquid carrier stuck to the surface of the squeeze roller 153*a* can be removed by a removal device, such as the blade 156*a* of FIG. 4, and recovered into the Y-ink reservoir 159*a*. The reason that the concentration of the toner image will typically be increased is to protect the toner image from being washed off by the ink applied to the same to form a toner image in another color.

The squeeze roller 153*a* also can act to charge the photoreceptor web 110 again to a predetermined potential to develop a toner image in another color, such as in the next sequential development unit. To this end, a relatively high voltage may be applied to the squeeze roller 153*a* so that the surface of the squeeze roller 153*a* is charged to a squeeze potential $V_s$ of about 800 volts or more, for example, which is higher than the charge potential. Thus, once the photoreceptor web 110 passes the squeeze roller 153*a*, the potential in the non-image region $A_3$ of the photoreceptor web 110 and the potential in the image region $B_3$ are equal to or higher than the charge potential. This can allow for development of a toner image of another color.

Because the surface of the squeeze roller 153*a* is charged to a relatively high potential, a toner image is formed in the image region $B_3$ by the repulsive force exerted between the squeeze roller 153*a* and the toner particles, and firmly adheres to the image region $B_3$ with increased binding force of the toner particles. As a result, no thinning of the toner image at its edges occurs by the pressing of the squeeze roller 153*a*. In addition, washing-off of the toner image by an ink applied to form another toner image does not typically occur, so that the shape and location of the toner image can be maintained intact.

After a Y-toner image is formed through the steps described above, in order to then develop a toner image of magenta (M), the surface of the photoreceptor web 110 is preferably irradiated by a light beam from the M-LSU 140*b* so that a latent electrostatic image corresponding to a M-toner image is formed. This latent electrostatic image can have a potential of about 100 volts, for example, and can be developed into a M-toner image by the M-development unit 150*b* in the same manner as for the Y-toner image, as described previously. Then a toner image of cyan (C) can sequentially be developed by the C-development unit 150*c*. This process is facilitated by the toner particles from Y, M, and C inks being selected to be transparent to the exposing wavelength.

After toner images are developed in three colors including yellow (Y), magenta (M) and cyan (C), a black (K) toner image can be developed by the K-development unit 150*d*. The concentration of the overlapping toner images previously formed on the photoreceptor web 110 can be adjusted to be suitable for electrostatic transfer by the K-development unit 150*d*.

The use of various rollers, particularly backup rollers, in the printer of the present invention is advantageous to maintain important gaps between rollers of the development units and the photoreceptor web or belt. Thus the gap development and maintenance as illustrated and explained relative to FIGS. 4 and 5 (both discussed above) is important to this apparatus. The maintenance of the various gaps between rollers at particular distances will affect print quality and image density. Without such backup rollers, it may be difficult to maintain the desired gaps for each nipped area (typically, two per developer unit) over the length of the photoreceptor web 110 (FIG. 3, between rollers 111 and 112). This is because capillary forces of the liquid ink in the controlled gap ($G_1$ and $G_2$ in FIG. 4) will act to pull the photoreceptor web 110 toward the developer roller, such as roller 151*a* of FIG. 4, and toward the toner removal roller, such as roller 152*a* of FIG. 4. If the tension of the photoreceptor web 110 is increased to resist the capillary force, belt troughing can occur before the capillary force can be overcome and this troughing will prohibit a uniform gap from being maintained.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. An electrostatic transfer type liquid electrophotographic printer comprising:

a continuous photoreceptor web having a charged surface and an opposing back surface, wherein the photoreceptor web rotates around a printing path;

at least one exposing unit for selectively discharging the charged surface of the photoreceptor web to form a latent electrostatic image;

at least one development unit for developing the latent electrostatic image on the photoreceptor web into a toner image with an ink containing a liquid carrier and charged toner particles, wherein the at least one development unit comprises a developer roller, a toner removal roller, and a squeeze roller, and at least one of the developer roller, the toner removal roller, and the squeeze roller have a corresponding backup roller adjacent to the back surface of the photoreceptor web, and wherein the photoreceptor web is arranged to provide at least 1 degree of contact wrap around the at least one backup roller; and an electrostatic transfer unit for transferring the toner image formed by the at least one development unit from the photoreceptor web to a print medium by electrostatic force.

2. The electrophotographic printer of claim 1, wherein each of the developer roller, the toner removal roller, and the squeeze roller have a corresponding backup roller.

3. The electrophotographic printer of claim 2, wherein the photoreceptor web is arranged to provide at least one degree of wrap around each of the backup rollers that correspond to the developer roller, the toner removal roller, and the squeeze roller.

4. The electrophotographic printer of claim 1, wherein the developer backup roller and the developer roller are positioned to provide a controlled gap between the developer roller and the photoreceptor web to facilitate electrostatic transfer of charged toner particles to the photoreceptor web.

5. The electrophotographic printer of claim 4, wherein the gap between the developer roller and the photoreceptor web is adjustable.

6. The electrophotographic printer of claim 1, wherein the toner removal backup roller and the toner removal roller are positioned to provide a controlled gap between the toner removal roller and the photoreceptor web.

7. The electrophotographic printer of claim 6, wherein the gap between the toner removal roller and the photoreceptor web is adjustable.

8. The electrophotographic printer of claim 1, wherein the squeeze backup roller and squeeze roller are positioned to contact opposite sides of the photoreceptor web to apply a controlled amount of pressure to the photoreceptor web.

9. The electrophotographic printer of claim 8, wherein the amount of pressure applied to the photoreceptor web by the squeeze backup roller and the squeeze roller is adjustable.

10. The electrophotographic printer of claim 1, wherein a plurality of development units are arranged sequentially around the printing path of the photoreceptor web, and wherein each development unit provides charged toner particles of a different color from the toner particles of the other development units.

11. The electrophotographic printer of claim 1, wherein the electrostatic transfer unit comprises a biased transfer roller to effect electrostatic transfer of toner images to a print medium by electrostatic force.

12. The electrophotographic printer of claim 1, further comprising a feedback system for measuring and adjusting the position of at least one backup roller relative to its corresponding developer roller, toner removal roller, and squeeze roller.

13. The electrophotographic printer of claim 1, further comprising a feedback system for measuring and adjusting the position of at least one of the developer roller, toner removal roller, and squeeze roller relative to the photoreceptor web.

14. The electrophotographic printer of claim 1, wherein the at least one development unit further comprises a concentration control unit for controlling the concentration of a toner image by adjusting the amount of liquid carrier applied to the photoreceptor web.

15. The electrophotographic printer of claim 14, wherein the concentration control unit comprises the toner removal roller of the at least one development unit and a concentration control roller, and wherein each of the toner removal roller and the concentration control roller has a corresponding backup roller.

16. The electrophotographic printer of claim 15, wherein the photoreceptor web is arranged to provide at least one degree of wrap around each of the backup rollers that correspond to the toner removal roller and the concentration control roller.

17. The electrophotographic printer of claim 16, wherein the toner removal roller and its corresponding backup roller are positioned to provide a controlled gap between the toner removal roller and the photoreceptor web.

* * * * *